US011363851B2

(12) United States Patent
Goldwitz

(10) Patent No.: US 11,363,851 B2
(45) Date of Patent: Jun. 21, 2022

(54) HELMET COOLING APPARATUS, HELMETS INCLUDING A COOLING APPARATUS, AND METHODS OF MAKING THE SAME

(71) Applicant: Brian Goldwitz, Orange, CT (US)

(72) Inventor: Brian Goldwitz, Orange, CT (US)

( * ) Notice: Subject to any disclaimer, the term of this patent is extended or adjusted under 35 U.S.C. 154(b) by 0 days.

(21) Appl. No.: 16/024,222

(22) Filed: Jun. 29, 2018

(65) Prior Publication Data

US 2019/0021433 A1 Jan. 24, 2019

Related U.S. Application Data

(60) Provisional application No. 62/527,736, filed on Jun. 30, 2017.

(51) Int. Cl.
*A42B 3/28* (2006.01)

(52) U.S. Cl.
CPC ..... *A42B 3/285* (2013.01); *A42B 3/283* (2013.01); *A42B 3/286* (2013.01)

(58) Field of Classification Search
CPC ..... A42B 3/28; A42B 3/281; A42B 3/283; A42B 3/285; A42B 3/286; A41D 13/0053; A41D 13/0056; A41D 13/0058
See application file for complete search history.

(56) References Cited

U.S. PATENT DOCUMENTS 3,548,415 A * 12/1970 Waters ..... A42B 3/286 2/171.3
5,345,614 A * 9/1994 Tanaka ..... A42B 3/281 2/425
5,561,862 A * 10/1996 Flores, Sr. ..... A42B 3/286 2/171.3
5,867,840 A * 2/1999 Hirosawa ..... A42B 3/128 2/414
5,937,446 A * 8/1999 Fallert ..... A42B 3/124 2/411
6,081,929 A * 7/2000 Rothrock ..... A42B 3/286 2/171.3

(Continued)

FOREIGN PATENT DOCUMENTS

EP 1101429 A1 * 5/2001 ..... A41D 13/0056
EP 1101429 A1 5/2001

(Continued)

OTHER PUBLICATIONS

PCT/US2018/040465. International Search Report and Written Opinion (dated Apr. 11, 2019).

*Primary Examiner* — Miguel A Diaz
(74) *Attorney, Agent, or Firm* — Loza & Loza, LLP; Tyler Barrett

(57) ABSTRACT

A helmet may include a cooling device coupled thereto, where the cooling device may include a fluid absorbing material that is sufficiently porous to facilitate airflow therethrough positioned within an air intake scoop. The air intake scoop may include a basin formed in part by a front edge of the air intake scoop and by a rear barrier in the air intake scoop. At least one vent aperture located behind the rear barrier. A fluid absorbing material may be disposed within at least a portion of the air intake scoop. At least one drainage aperture may be positioned within a sidewall of the air intake scoop and located at least partially below a top surface of the rear barrier.

6 Claims, 6 Drawing Sheets

(56) References Cited

U.S. PATENT DOCUMENTS 6,932,150 B1 * 8/2005 Yeh ..... A42B 3/285 165/104.21
6,954,944 B2 * 10/2005 Feher ..... A42B 3/285 128/201.24
7,296,304 B2 * 11/2007 Goldsborough ..... A42B 3/285 2/171.3
7,849,524 B1 * 12/2010 Williamson ..... A42B 3/285 2/410
7,937,775 B2 * 5/2011 Manzella, Jr ..... A41D 13/0025 2/171.3
8,156,570 B1 * 4/2012 Hockaday ..... A41D 13/0025 2/7
8,550,650 B1 * 10/2013 McGinty ..... A42B 3/044 362/105
8,695,121 B2 * 4/2014 Nolan ..... A42B 3/286 2/171.3
8,756,715 B1 6/2014 Moffitt, Jr.
2004/0074250 A1 * 4/2004 Junkins ..... A42B 3/285 62/259.3
2004/0255364 A1 * 12/2004 Feher ..... A42B 3/285 2/171.3
2006/0053529 A1 * 3/2006 Feher ..... A42B 3/285 2/171.3
2006/0101556 A1 * 5/2006 Goldsborough ..... A42B 3/285 2/171.3
2010/0005572 A1 * 1/2010 Chaplin ..... A42B 3/285 2/411
2011/0219506 A1 9/2011 Uttrachi
2013/0185837 A1 * 7/2013 Phipps ..... A42B 3/12 2/2.5
2015/0020292 A1 * 1/2015 Diaz ..... A42C 5/04 2/171.2
2015/0143613 A1 * 5/2015 Chu ..... A42B 1/0182 2/171.3
2016/0007672 A1 * 1/2016 Ku ..... A42B 1/008 2/171.3
2018/0103711 A1 * 4/2018 Abrahamson ..... A42B 3/286
2018/0103712 A1 * 4/2018 Krishnan ..... A42B 3/285
2019/0021433 A1 * 1/2019 Goldwitz ..... A42B 3/286
2019/0150548 A1 * 5/2019 Albani ..... B01D 53/0415
2019/0150551 A1 * 5/2019 Clark ..... A42C 5/04
2020/0229530 A1 * 7/2020 Feher ..... A42B 3/286

FOREIGN PATENT DOCUMENTS

JP 2001303353 A * 10/2001 ..... A42B 3/285
KR 2009-0011189 U 11/2009
KR 10-1104449 B1 1/2012
WO WO-2016024154 A2 * 2/2016 ..... B01D 53/0415
WO WO-2018152264 A1 * 8/2018 ..... A42B 3/286

* cited by examiner

HELMET COOLING APPARATUS, HELMETS INCLUDING A COOLING APPARATUS, AND METHODS OF MAKING THE SAME

PRIORITY CLAIM

The present application for patent claims priority to Provisional Application No. 62/527,736 entitled "Helmet Cooling Apparatus, Helmets Including A Cooling Apparatus, And Methods Of Making The Same" filed Jun. 30, 2017, the entire disclosure of which is incorporated by reference herein.

TECHNICAL FIELD

The technology discussed below relates generally to helmets, and more specifically to devices and methods for cooling the inside of a helmet when in use.

BACKGROUND

Riders of various types of open wheeled vehicles, such as, for example, motorcycles, generally wear head protective helmets, and, in the case of racing vehicles, such as motorcycles, they are required to wear such helmets. While the helmets afford a large measure of head and neck protection, especially in those cases where there is a crash or the cyclist is unseated, they are heavy and also exhibit a high degree of heat retention. Thus, in the case of motorcycle racing, the rider tends to experience a great deal of discomfort from the retained heat, and both the heat and weight of the helmet result in premature tiring of the rider.

Helmet manufacturers generally provide vents or air intake openings in helmets, typically in the front portion of the helmet facing the oncoming air flow while driving. However, the ambient air alone may not be sufficient to cool a user's head during use, especially when the weather is relatively hot. It would accordingly be beneficial to provide a helmet cooling apparatus that can cool ambient air that enters into such air intake openings.

BRIEF SUMMARY OF SOME EXAMPLES

According to one or more embodiments of the present disclosure, helmet cooling devices and helmets including such devices are disclosed.

Other aspects, features, and embodiments associated with the present disclosure will become apparent to those of ordinary skill in the art upon reviewing the following description in conjunction with the accompanying figures.

DRAWINGS

FIG. 5 is a back view of the cooling device detached from the helmet according to at least one embodiment.

DETAILED DESCRIPTION

The illustrations presented herein are, in some instances, not actual views of any particular cooling apparatus or helmet, but are merely idealized representations which are employed to describe the present disclosure. Additionally, elements common between figures may retain the same numerical designation.

Figure 1:
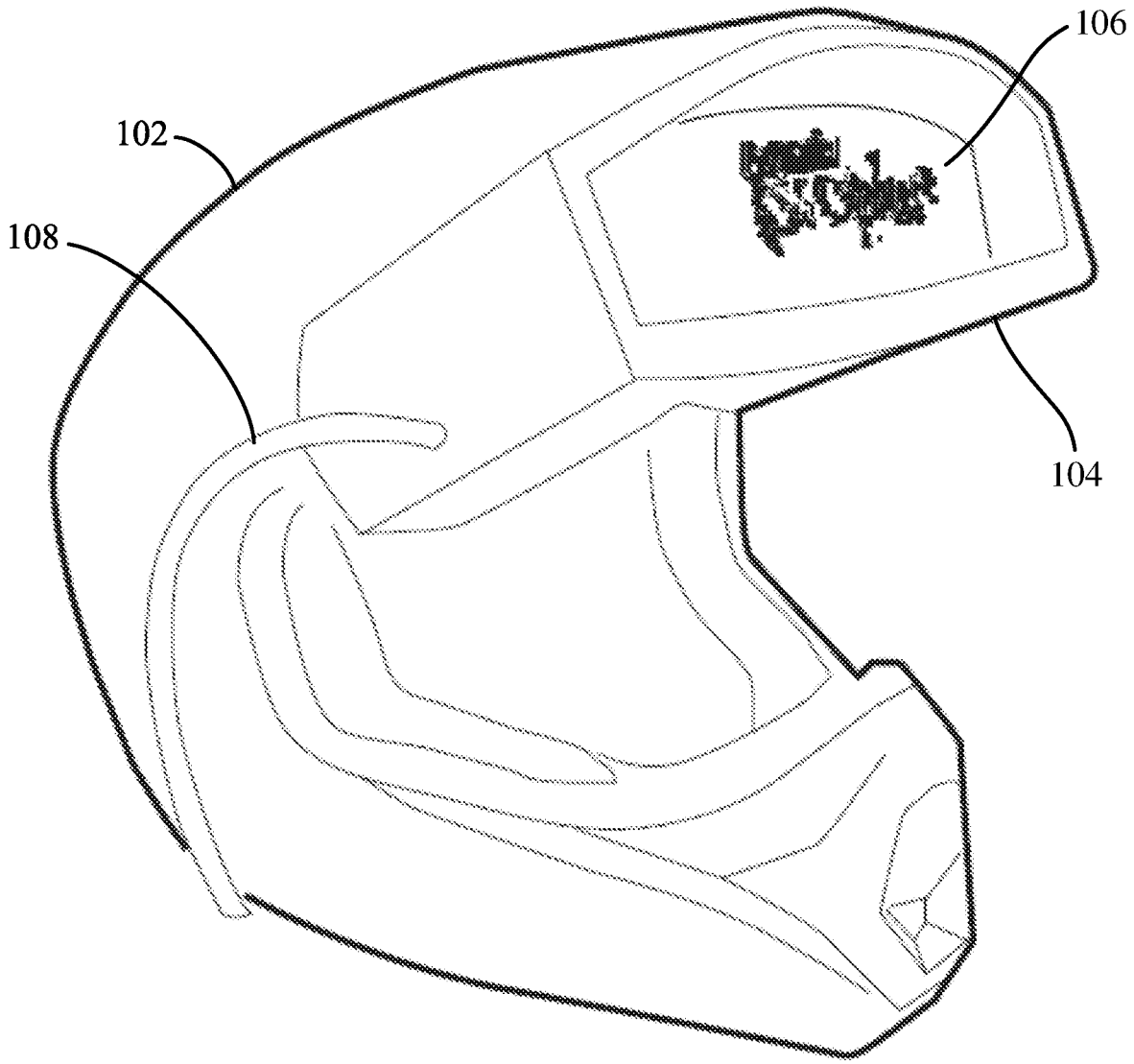
FIG. 1 is an image of a helmet with a cooling device according to at least one embodiment of the present disclosure.

Various embodiments of the present disclosure include cooling devices configured to be employed with a helmet. Referring to FIG. 1, a view of a helmet with a cooling device is shown according to at least one embodiment of the present disclosure. As depicted, a helmet 102 may include a cooling device 104 coupled thereto. The cooling device 104 may include a fluid absorbing material 106 that is sufficiently porous to facilitate airflow therethrough positioned within an air intake scoop 202 (see FIG. 2). In the present disclosure, the fluid absorbing material 106 may be referred to as a sponge 106. It should be understood that a sponge 106 does not necessarily limit the disclosure to a sponge material, but simply to a material that both absorbs a fluid like water and also facilitate airflow through the fluid absorbed material to enable the air to be cooled by the absorbed fluid.

Figure 2:
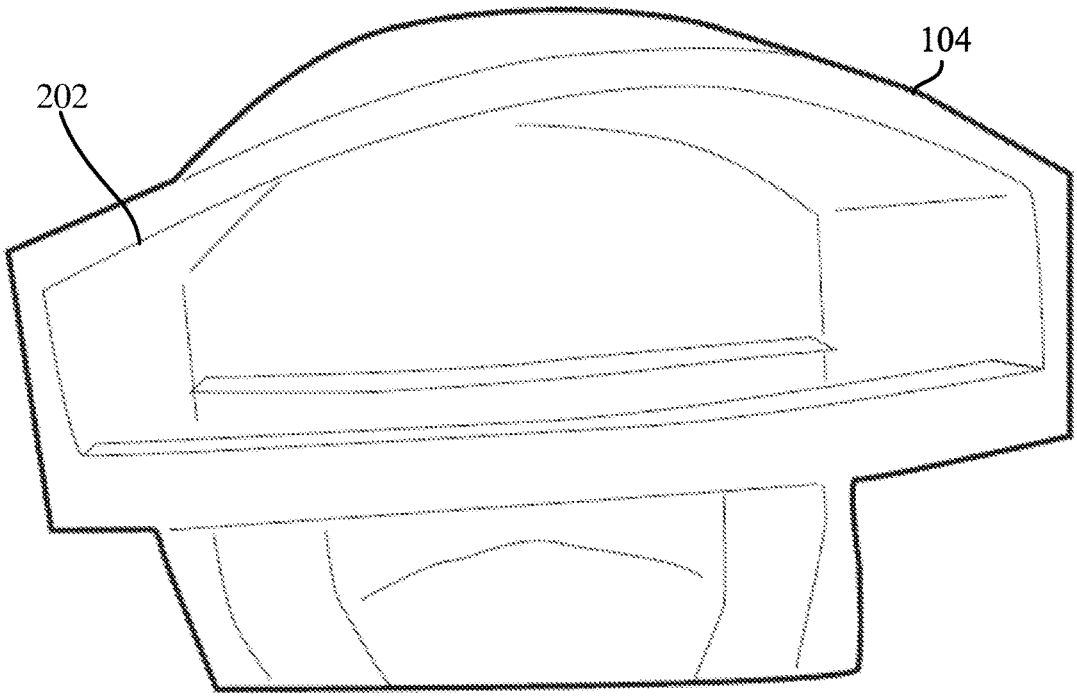
FIG. 2 is a front view of the helmet with the cooling device coupled thereto according to at least one embodiment.
Figure 3:
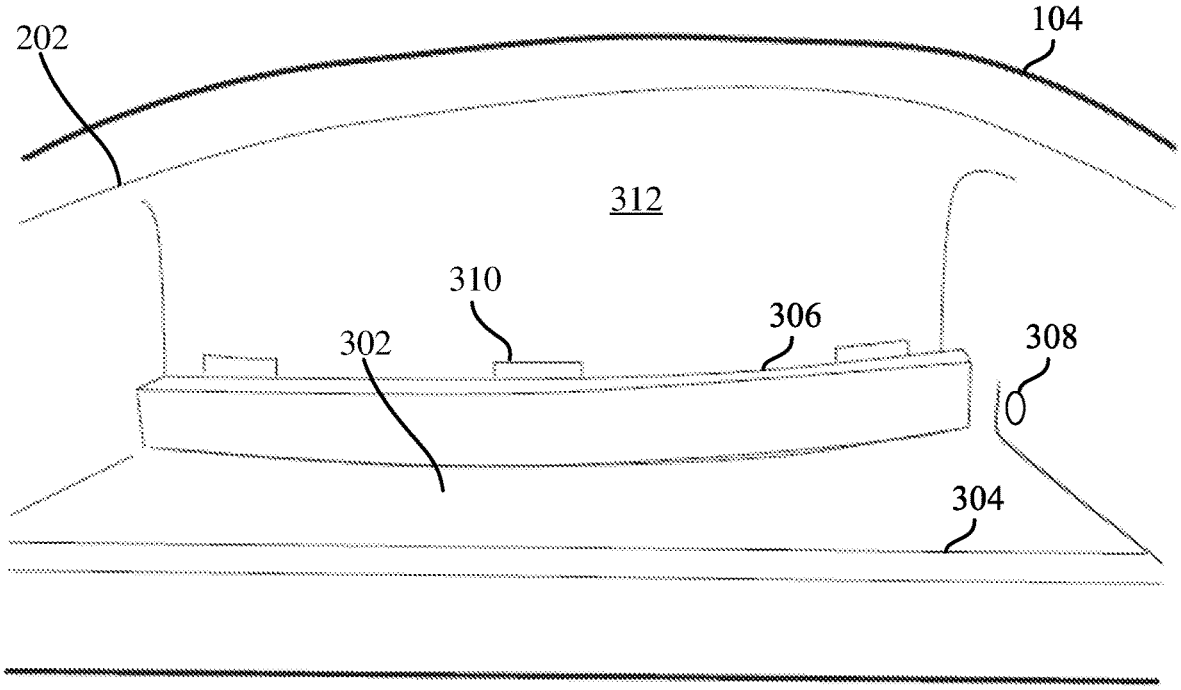
FIG. 3 is a view of the air scoop of the cooling device according to at least one embodiment of the present disclosure.

Referring to FIGS. 2 and 3, the cooling device 104 may be configured with an air intake scoop 202 sized and shaped to connect to a helmet 102 and to capture air flowing toward the helmet. According to at least one aspect of the present disclosure, the air intake scoop 202 can include a basin 302 formed in part by a front edge 304 of the air intake scoop 202 and by a rear barrier 306. The basin 302 can catch water that may drip from the sponge 106 positioned within the air intake scoop 202 to keep it from flowing into the helmet during use.

To facilitate drainage of the basin 302, at least one aperture 308 is formed in a sidewall of the air intake scoop 202 and positioned at least partially below the top of the rear barrier 306. Referring back to FIG. 1, a hose 108 can be coupled to each of the one or more apertures 308 to direct water draining from the basin 302 away from the helmet 102.

Figure 4:
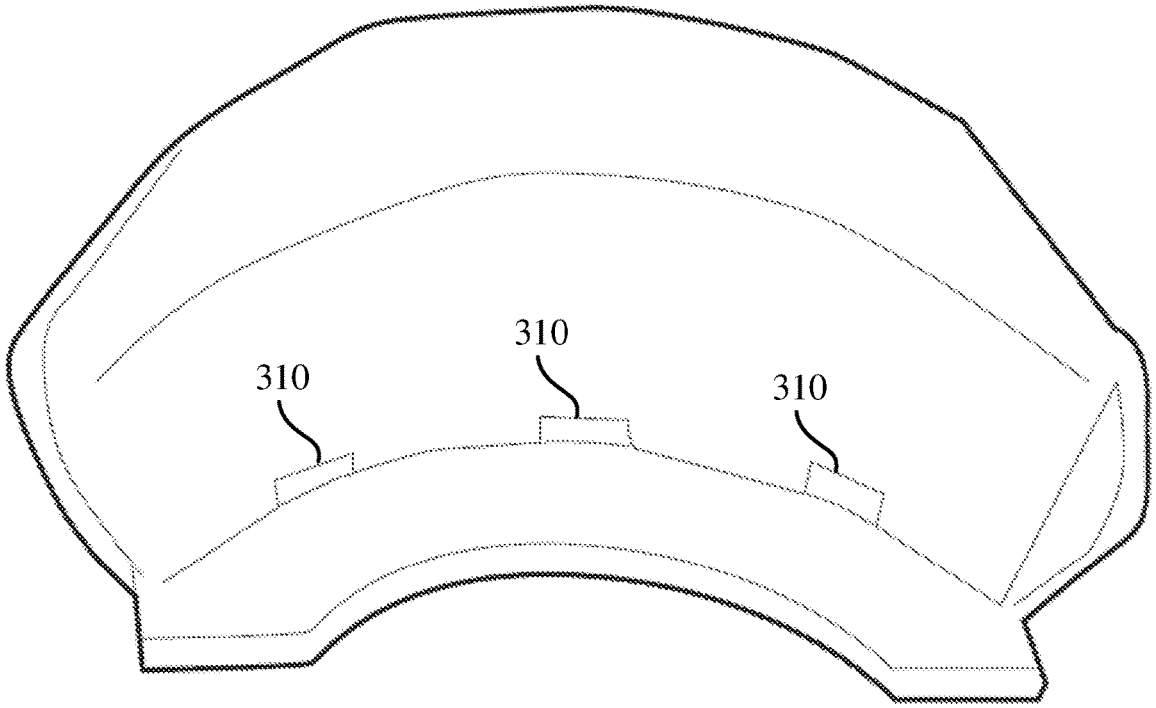
Figure 5:
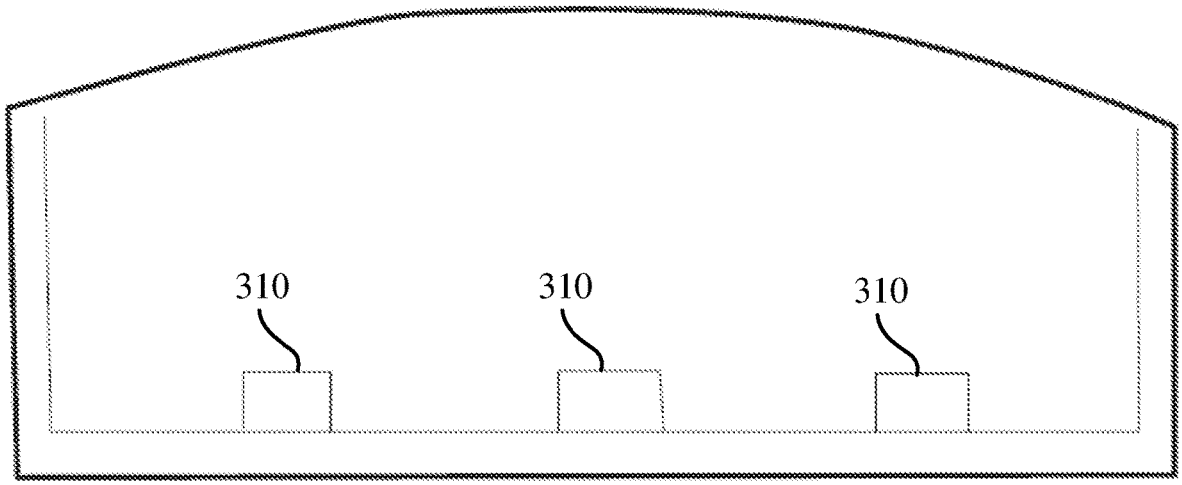
FIG. 5 is an isometric back view of the cooling device detached from the helmet according to at least one embodiment.

Referring to FIGS. 3, 4, and 5, one or more vent apertures 310 can be positioned within the rear wall 312 of the air intake scoop 202 behind the rear barrier 306. The vent apertures 310 are positioned to facilitate air flow from the air intake scoop 202 into the helmet.

In operation, the sponge 106 can be soaked with water and positioned within the air intake scoop 202. As a user moves in a forward direction, air flows into the air intake scoop 202 and through the sponge 106 and is cooled by the water absorbed into the sponge 106. The cooled air flows to the back of the air intake scoop 202 and through the vent apertures 310 to the head of the person wearing the helmet.

Any excess water from the sponge 106 may drip into the basin 302 and drained through the one or more apertures 308.

Figure 6:
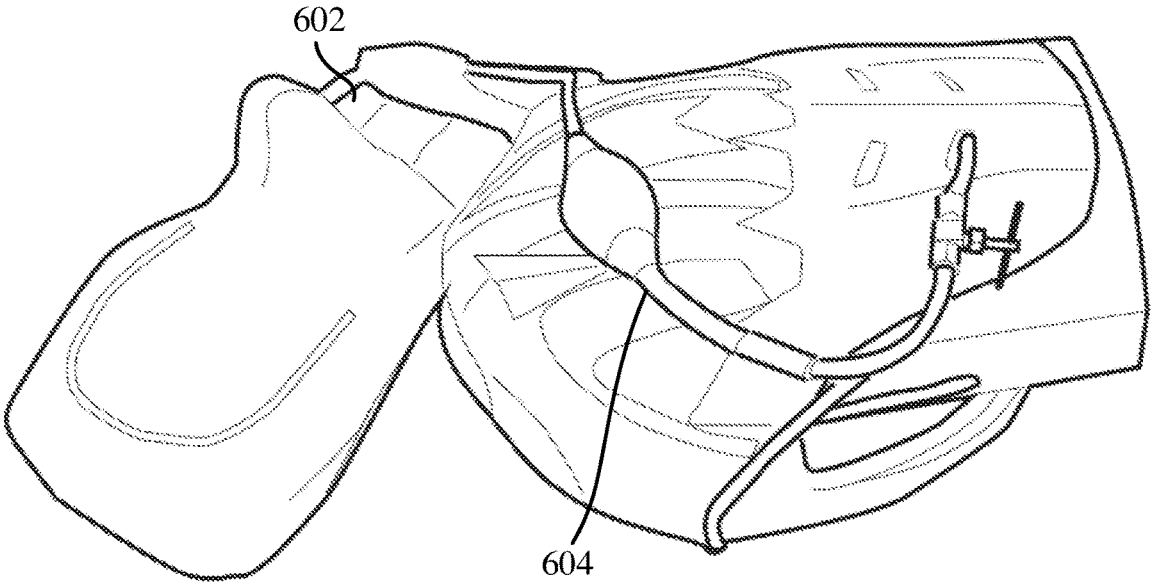
FIG. 6 is a view of a water supply system according to at least one embodiment of the present disclosure.
Figure 7:
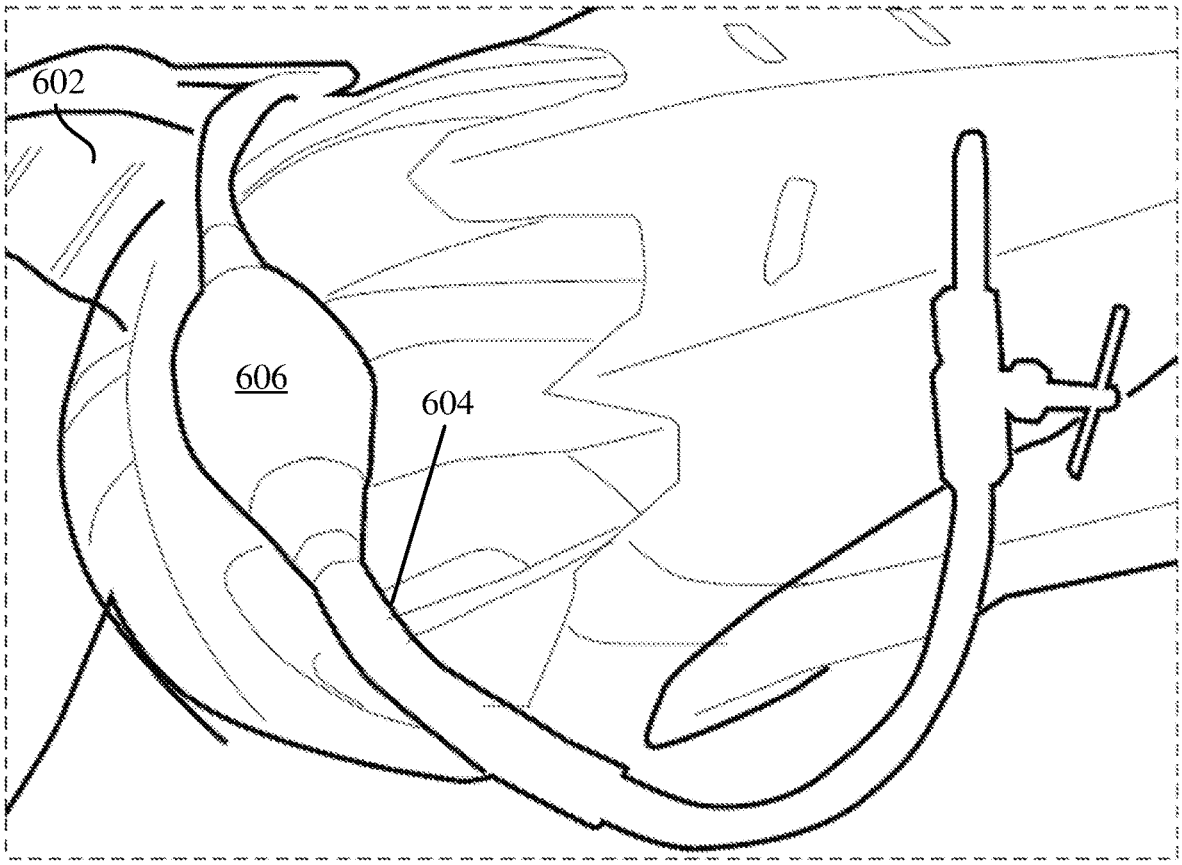
FIG. 7 is another view of the water supply system of FIG. 6.

In some embodiments, an external supply of water or other fluid may be provided to the sponge 106. For example, as shown in FIGS. 6 and 7, a water supply system may be provided. As depicted, a water supply 602 may be provided with a hose 604 extending from the water supply 602 to the sponge 106 within the air intake scoop 202. A pump 606 can be included to pump the fluid from the water supply 602 to the sponge 106. Such a pump 606 may be a manual hand pump mechanism or may be a pump controlled by a power supply (e.g., battery, solar, etc.).

Figure 8:
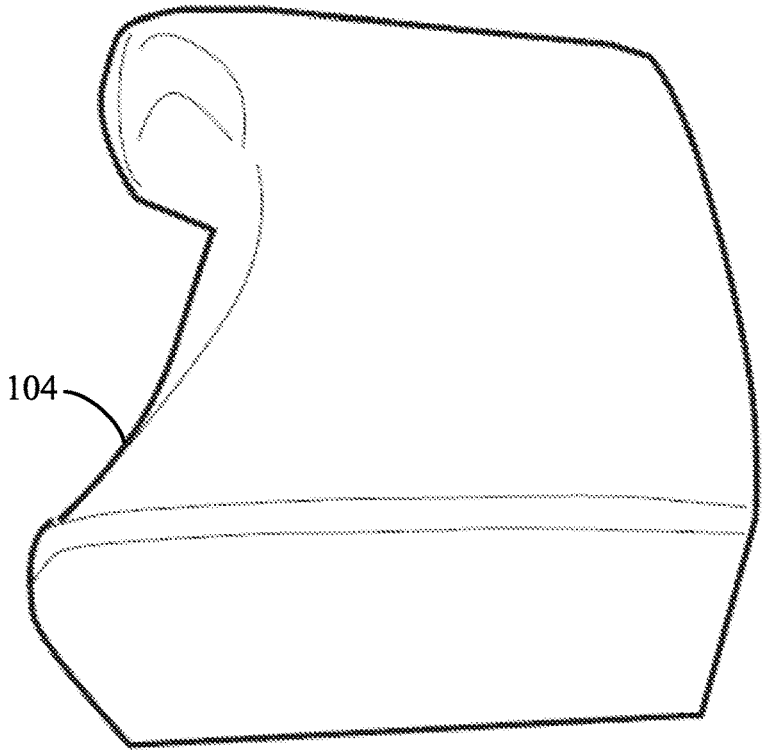
FIG. 8 is an isometric view of the cooling device according to at least one embodiment of the present disclosure.
Figure 9:
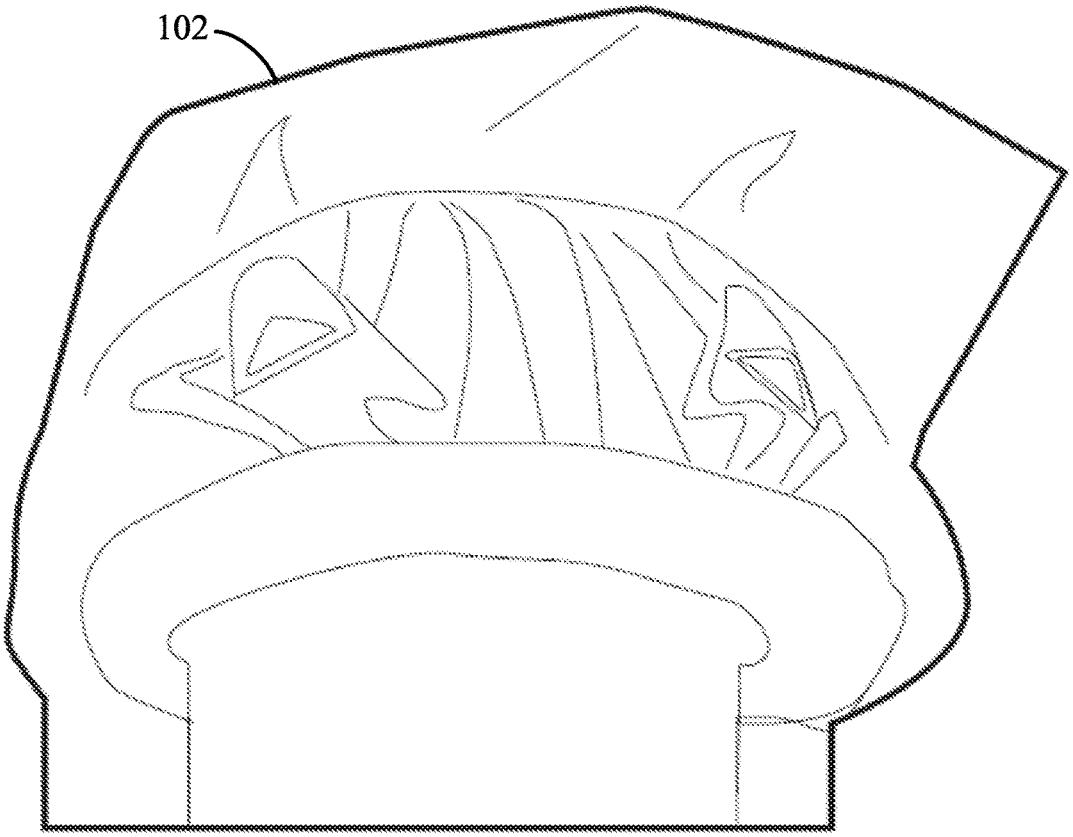
FIG. 9 is a view of a helmet according to at least one embodiment of the present disclosure.
Figure 10:
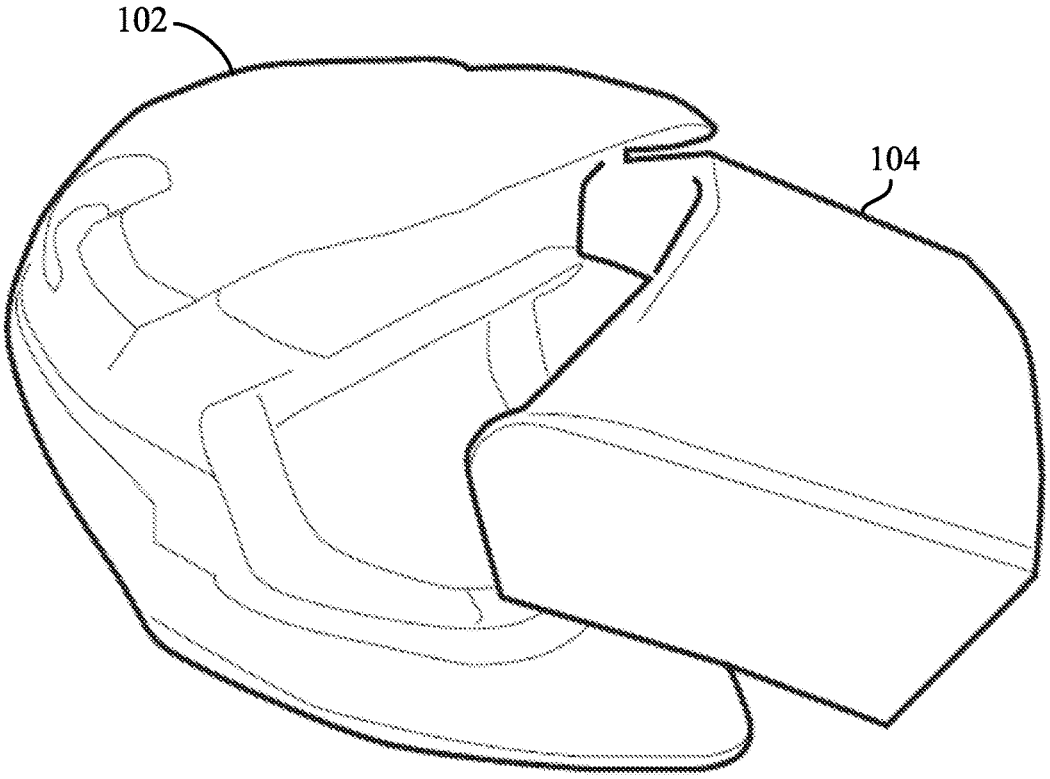
FIG. 10 is a view of a helmet with a detachable cooling device according to at least one embodiment.
Figure 11:
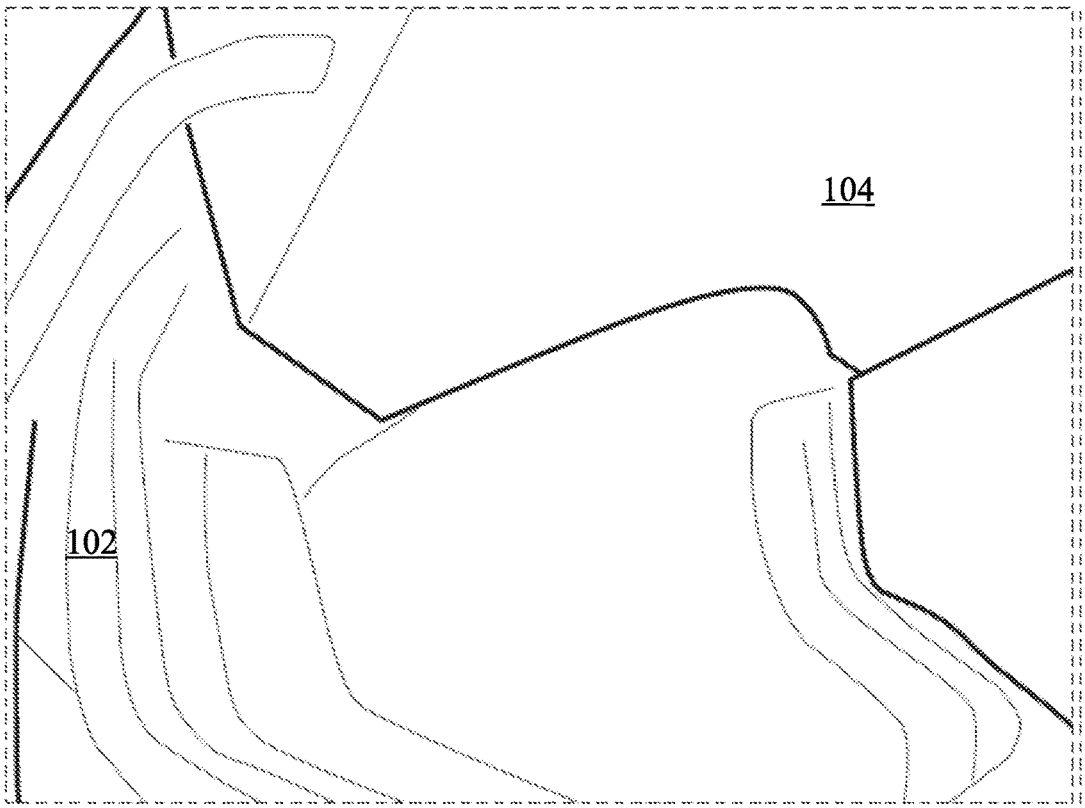
FIG. 11 is a view of the cooling device coupled to the helmet according to at least one embodiment.

According to various embodiments of the present disclosure, cooling devices 104 of the present disclosure may be integral to the helmet 102. That is, some embodiments may include a cooling device 104 of the present disclosure built into the helmet 102 as part of the helmet 102. According to one or more additional embodiments, cooling devices 104 of the present disclosure may be coupled to any model of helmet 102 such that the cooling device 104 is detachable as desired. FIG. 8 shows a cooling device 104 detached from a helmet 102 shown in FIG. 9. In FIG. 10, the cooling device 104 is being attached to the helmet 102, and FIG. 11 shows the cooling device 104 coupled to the helmet 102. Although the depicted example shows the cooling device 104 at a specific location on the helmet 102, it should be understood that one or more cooling device 104 can be positioned at different locations according to various embodiments of the present disclosure.

In some embodiments, a fan may further be included within a portion of the air intake scoop 104. The fan may be sized and configured to facilitate airflow through the scoop and into the helmet. Such a fan can increase the airflow when the helmet is in motion and/or can provide airflow when the helmet is moving relatively slowly or when the helmet is stationary.

Additional aspects of the present disclosure include methods of making the cooling device 104 as described herein by forming the various components and features, and coupling the components together as described and depicted.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art.

What is claimed is:

1. A cooling device, comprising:

an air intake scoop comprising a basin formed in part by a front edge of the air intake scoop, the front edge forming a raised surface extending at a consistent height across a front portion of the basin, and by a rear barrier in the air intake scoop;

at least one vent aperture located behind the rear barrier; and a fluid absorbing material positioned between the front edge of the air intake scoop and the rear barrier in the air intake scoop and located such that air passing into the air intake scoop passes through the fluid absorbing material, and then passes from the fluid absorbing material into the at least one vent aperture, the fluid absorbing material configured to absorb a fluid and to facilitate airflow through the fluid absorbing material.

2. The cooling device of claim 1, further comprising at least one drainage aperture positioned within a sidewall of the air intake scoop and located at least partially below a top surface of the rear barrier.

3. The cooling device of claim 1, further comprising a water supply system comprising:

a water supply container;

a hose extending between the water supply container and the air intake scoop; and a pump in fluid communication with at least one of the water supply container and the hose to pump fluid from the water supply container to the fluid absorbing material in the air intake scoop.

4. A helmet cooling system, comprising:

a helmet;

an air intake scoop coupled to the helmet, the air intake scoop comprising a front edge including a raised surface extending at a consistent height, a rear barrier, and a basin located between, and at least partially formed by the front edge and the rear barrier;

at least one vent aperture positioned behind the rear barrier relative to a front of the air intake scoop, the at least one vent aperture located at least partially below a top edge of the rear barrier; and a fluid absorbing material disposed between the front edge and the rear barrier in the air intake scoop and located such that air passing into the air intake scoop passes through the fluid absorbing material, and then passes from the fluid absorbing material into the at least one vent aperture, the fluid absorbing material configured to absorb a fluid and to facilitate airflow through the fluid absorbing material.

5. The helmet cooling system of claim 4, further comprising at least one drainage aperture positioned within a sidewall of the air intake scoop and located at least partially below the top edge of the rear barrier.

6. The helmet cooling system of claim 4, further comprising a water supply system comprising:

a water supply container;

a hose extending between the water supply container and the fluid absorbing material; and a pump in fluid communication with at least one of the water supply container and the hose to pump fluid from the water supply container to the fluid absorbing material.

* * * * *